US006334456B1

(12) United States Patent
Nevak

(10) Patent No.: US 6,334,456 B1
(45) Date of Patent: Jan. 1, 2002

(54) MULTI-LEVEL PORTABLE HOUSING STRUCTURE

(76) Inventor: Christopher Nevak, P.O. Box 217, Bethel, AK (US) 99559

( * ) Notice: Subject to any disclaimer, the term of this patent is extended or adjusted under 35 U.S.C. 154(b) by 0 days.

(21) Appl. No.: 09/502,416

(22) Filed: Feb. 10, 2000

(51) Int. Cl.[7] ..... B04H 15/36

(52) U.S. Cl. ..... 135/135; 135/87; 135/96; 135/115; 52/82; 52/2.18; 52/2.19; 52/3; 52/263; 108/147.12

(58) Field of Search ..... 135/87, 96, 124, 135/135, 121, 114–115, 137, 120.3; 52/2.11, 2.13, 2.16, 2.18, 2.19, 2.22, 2.23, 2.24, 2.25, 3, 82–83, 126.1, 126.6, 263; 108/147.12–147.15, 187

(56) References Cited

U.S. PATENT DOCUMENTS 3,625,235 A * 12/1971 Gorgichuk ..... 135/87
3,771,273 A * 11/1973 Brodie ..... 52/646
4,148,332 A * 4/1979 Huddle ..... 135/123
4,384,435 A * 5/1983 Polise et al. ..... 52/2.19
4,630,417 A * 12/1986 Collier ..... 52/263
5,341,610 A * 8/1994 Moss ..... 52/82
5,724,775 A * 3/1998 Zobel, Jr. et. al. ..... 52/581 X
5,860,251 A * 1/1999 Gleich ..... 52/2.18 X
6,022,165 A * 2/2000 Lin ..... 403/231
6,192,633 B1 * 2/2001 Hilbert ..... 52/2.18

* cited by examiner

*Primary Examiner*—Winnie Yip
(74) *Attorney, Agent, or Firm*—Michael J. Tavella

(57) ABSTRACT

A large multi-level tent that has an interior divided into two levels. The tent is a ¾ sphere that is supported by shaped tubes, a set of braces, and a top band. The platform has polyvinylchloride (PVC) posts to secure the platform to the ground. Each post extends upward to the full desired height for a two level living space. Metal brackets are secured to the vertical posts at each floor location. These brackets hold 2×4 horizontal wooden frame members. The frame members are reinforced with additional wood framing, similar to deck construction. Each deck is then covered with plywood sheathing to form a "floor" surface. After the platform is built, the tent is constructed around it. The tent has frame, which is covered by a canvas outer covering that is attached to all the tent frame elements.

13 Claims, 10 Drawing Sheets

MULTI-LEVEL PORTABLE HOUSING STRUCTURE

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to portable structures and particularly multi-level portable structures.

2. Description of Related Art

Tents have been used for centuries as temporary shelters for travelers or for semi-permanent housing units in warmer climates. Tents have been designed in many styles and with many features. However, virtually all tents have been designed as single-story structures. This makes living in tents uncomfortable at best and miserable at worst. All sleeping, eating and cooking must be carried out at the same level.

BRIEF SUMMARY OF THE INVENTION

The invention is a large multi-level tent that has an interior divided into two levels. A platform system is included within the tent to divide it into the levels. The tent is built up around the platform. The tent has an outer covering made of canvas and a set of frame elements that make assembly of the tent easy. The tent is a ¾ sphere that is supported by shaped tubes, a set of braces, and a top band.

The platform is a combination of wood, metal and plastic. Polyvinylchloride (PVC) posts are used to secure the platform to the ground. They have an auger base to anchor then securely. Each post extend upward to the full desired height for a two level living space. Metal brackets are secured to the vertical posts at each floor location. These brackets hold 2×4 horizontal wooden frame members. The frame members are reinforced with additional wood framing, similar to deck construction. Each deck is then covered with plywood sheathing to form a "floor" surface.

After the platform is built, the tent is constructed around it. The tent has a number of lower frame elements, a number of vertical elements and a top ring. The lower frame elements are joined in a circle. The vertical elements are attached to the lower frame elements at the connection joints. These vertical elements are secured by the top ring to form a semi-spherical frame. This frame is covered by a canvas outer covering that is attached to all the tent frame elements. Stakes are used to secure the tent to the ground. The tent has openings for doors and ventilation. The top ring is also fitted with a cover to prevent water from entering the tent.

Once assembled, the structure has two living levels. The upper level can be used for sleeping and the lower level can be used for living. In this way, bedding and other supplies do not have to be moved or stored while doing different activities.

Thus, this tent system makes a comfortable long term camp for doing fieldwork of any kind.

DETAILED DESCRIPTION OF THE INVENTION

Figure 1:
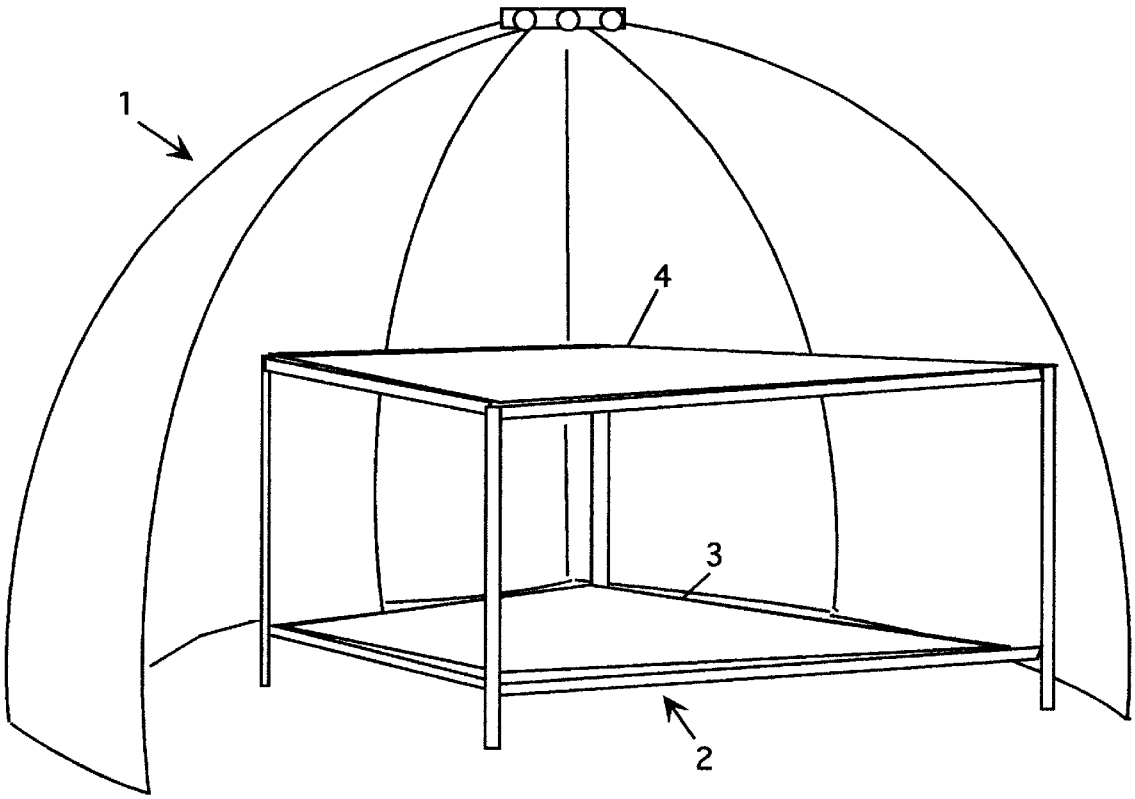
FIG. 1 is a partial cut-away view of the tent showing the interior two-level platform in place.

Referring now to FIG. 1, the tent 1 and platform 2 are shown. In the preferred embodiment, the tent has an overall diameter of 16 feet and a height of 10 feet. The internal platform is 12 feet long by 8 feet wide. The lower floor 3 of the platform is designed to lie about 1 foot above the ground. The upper floor 4 of the platform is designed to be five feet above the top of the lower floor 3.

Figure 2:
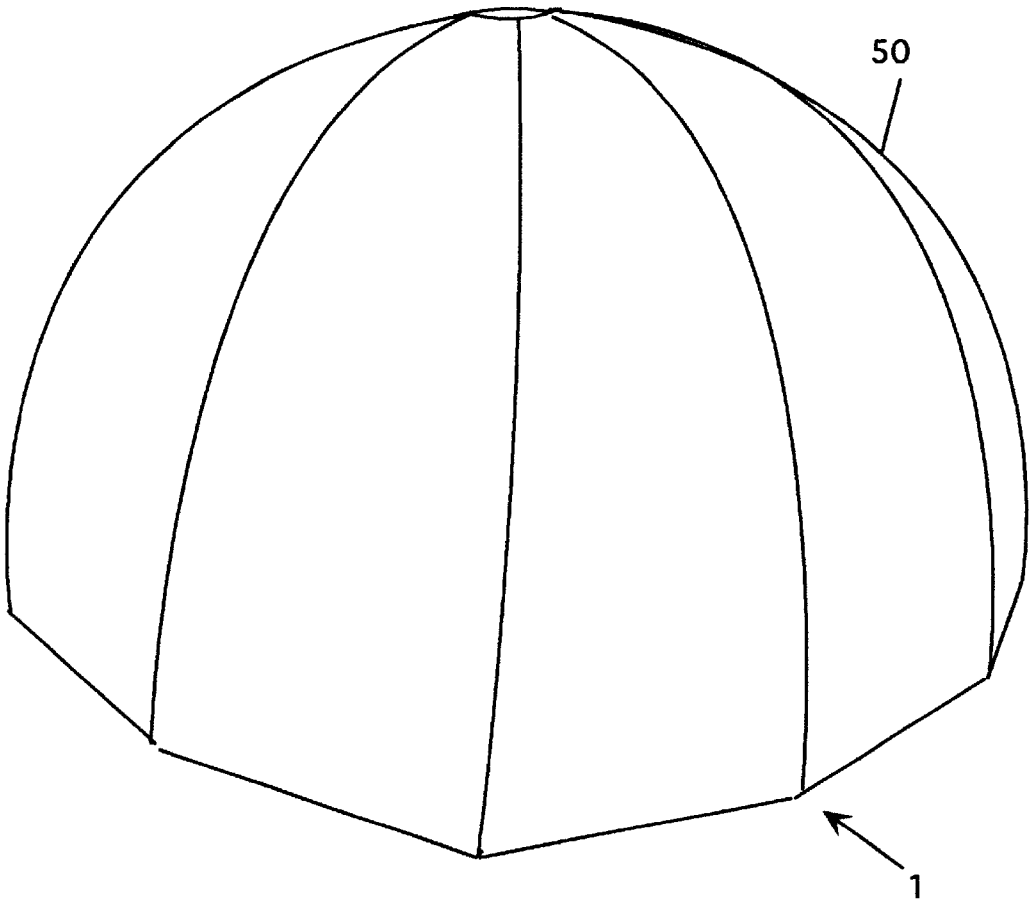
FIG. 2 is a perspective view of the invention with the tent fully closed.

FIG. 2 shows the tent fully assembled and closed. The platform 2 is entirely within this tent structure.

Figure 3:
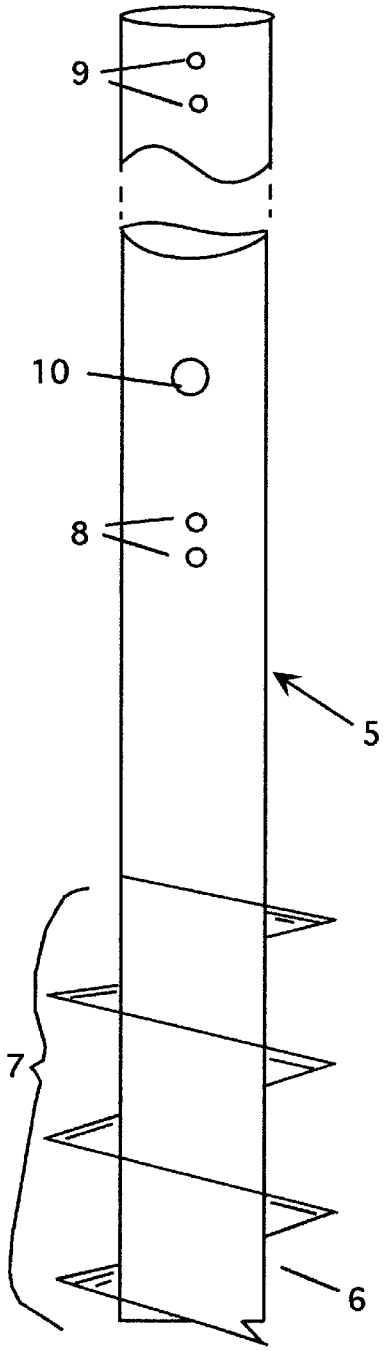
FIG. 3 is a detail view of a vertical support post, showing the auger base.

The platform is installed using four vertical members 5. FIG. 3 shows one form of the vertical members. Each vertical member has a number of components. The bottom 6 of each vertical member 5 has an auger portion 7. This portion is used to screw the vertical member into the ground. In the preferred embodiment, the auger portion 7 is approximately 1 foot long. The vertical members are made of 4-inch pipe. In the preferred embodiment, the vertical members are made of schedule 40 Polyvinylchloride (PVC) pipe. A number of holes are drilled in this pipe. A lower set of holes 8 and an upper set of holes 9 are used to secure the floor brackets (discussed below). A center hole 10 is used to pass a rod through. The rod is used to help screw the vertical member into the ground.

Figure 3A:
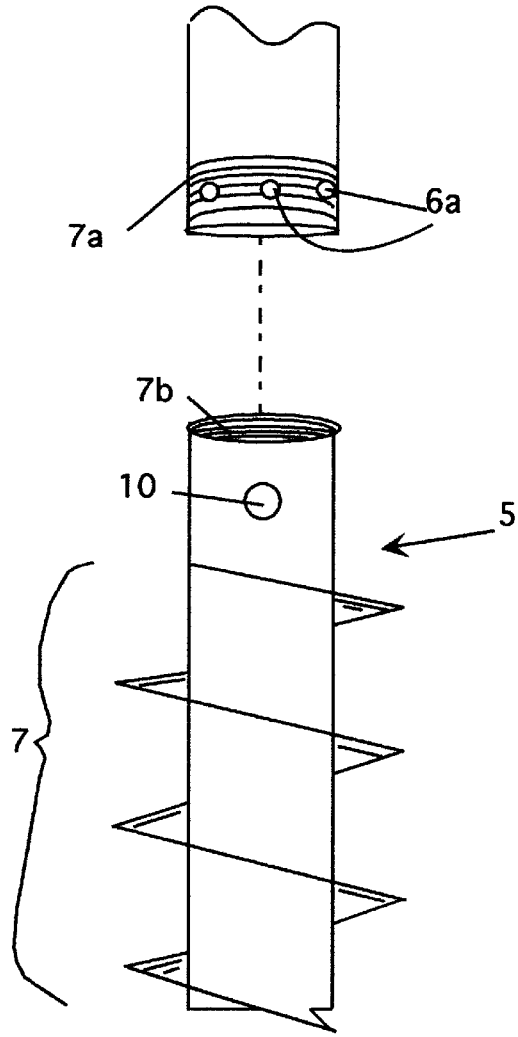
FIG. 3*a* is a detail view of the vertical support and auger base, showing a threaded connection.

FIG. 3*a* shows an alternative form of the vertical member 5 and auger portion 7. Here, the vertical member and auger portion are made in two pieces. The auger portion has a set of female threads 7*b* and the vertical member 5 has a set of male threads 7*a*. In this way, the two parts can be installed separately. In this design, the center hole 10 is relocated to the auger portion 5 as shown. Four mounting holes 6*a* are provided around the perimeter of the lower portion of the vertical member 6 as shown.

Figure 4:
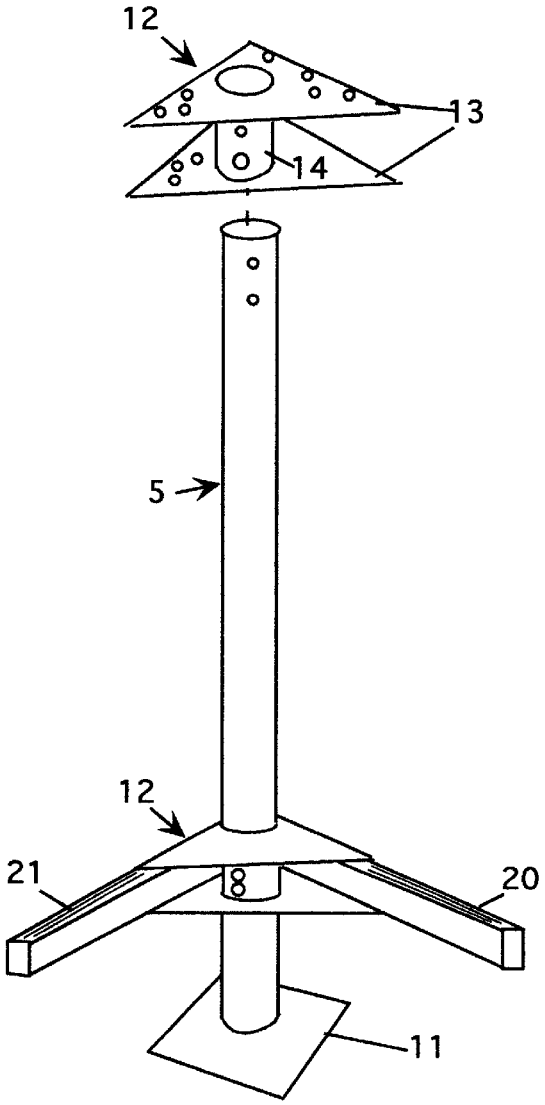
FIG. 4 is a detail view of a vertical support post with the base plate, and corner brackets installed, and showing two 2×4 frame members in the lower corner bracket.
Figure 5:
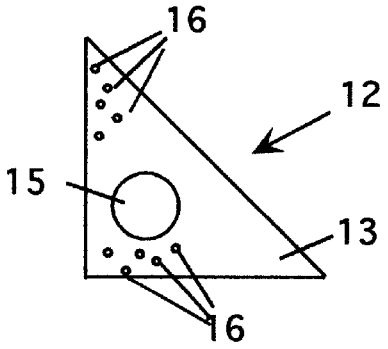
FIG. 5 is a top view of a corner bracket.
Figure 6:
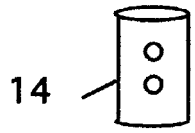
FIG. 6 is a side view of a spacer portion of the corner brackets.

FIG. 4 shows the vertical member 6 with a base plate 11 placed on the bottom. This plate covers the auger portion and provides some lateral stability for the vertical members. Two floor brackets 12 are used on each vertical member. The floor brackets are made of lightweight metal. Each floor bracket has two triangular mounting plates 13. FIG. 5 shows a top view of one mounting plate 13. The two plates 13 are separated by a spacer 14. The spacer has a diameter slightly larger than the diameter of the vertical member. FIG. 6 shows the spacer 14. Note too that the mounting plates have central holes 15 of the same size as the spacer. The spacer is designed to provide room for a standard 2×4 piece of dimensional lumber. The floor brackets are place over the top of the vertical member and are slid down until they align with the holes 8 or 9. Once aligned with the proper sets of holes, the floor brackets are bolted to the vertical member using fasteners common to the art.

Figure 4B:
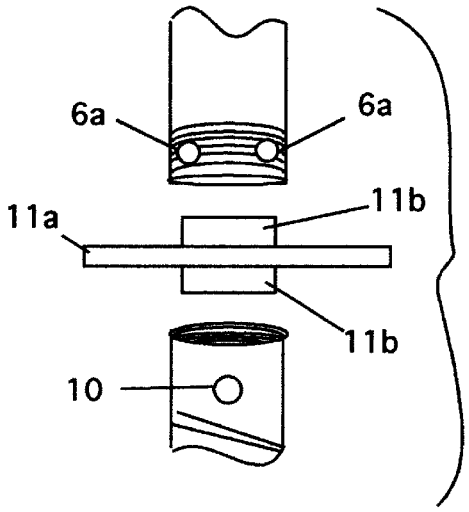
FIG. 4*b* is a detail of an alternative base plate connection.

With the threaded auger and vertical members, the base plate 11 can be installed with a hole to allow the auger and vertical member to be screwed together. Alternatively, The base plate 11*a* of FIG. 4*b* may be used. Here, two wooden blocks 11*b* are attached to the base plate 11*a* as shown. The auger and vertical member fit over the blocks as shown. Once in place the auger and vertical member can be secured to the blocks using the mounting holes 10 for the auger and 6*b* for the vertical member 5. In this way, it is possible to assemble the platform without the augers.

Figure 7:
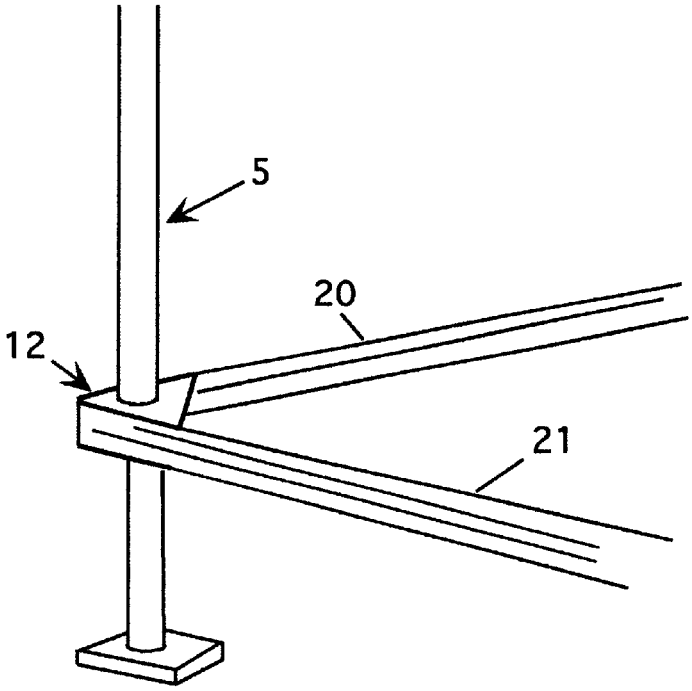
FIG. 7 is a perspective view of the corner brackets showing the 2×4 framing in place.

The platform requires four vertical members set in a rectangular pattern. Once the first vertical member is placed, the other members are positioned according to the steps discussed below. After the vertical members are in place, the horizontal framing can be added. This framing used standard 2×4 lumber. As shown in FIG. 5, the floor bracket plates have a number of holes 16 formed in them. These holes are used to secure the 2×4 lumber to the floor brackets. Nails or similar fasteners may be used to secure them in place. FIG. 7 shows how the 2×4s 20 and 21 are placed to align in the brackets without having to miter or cut the ends.

Figure 8:
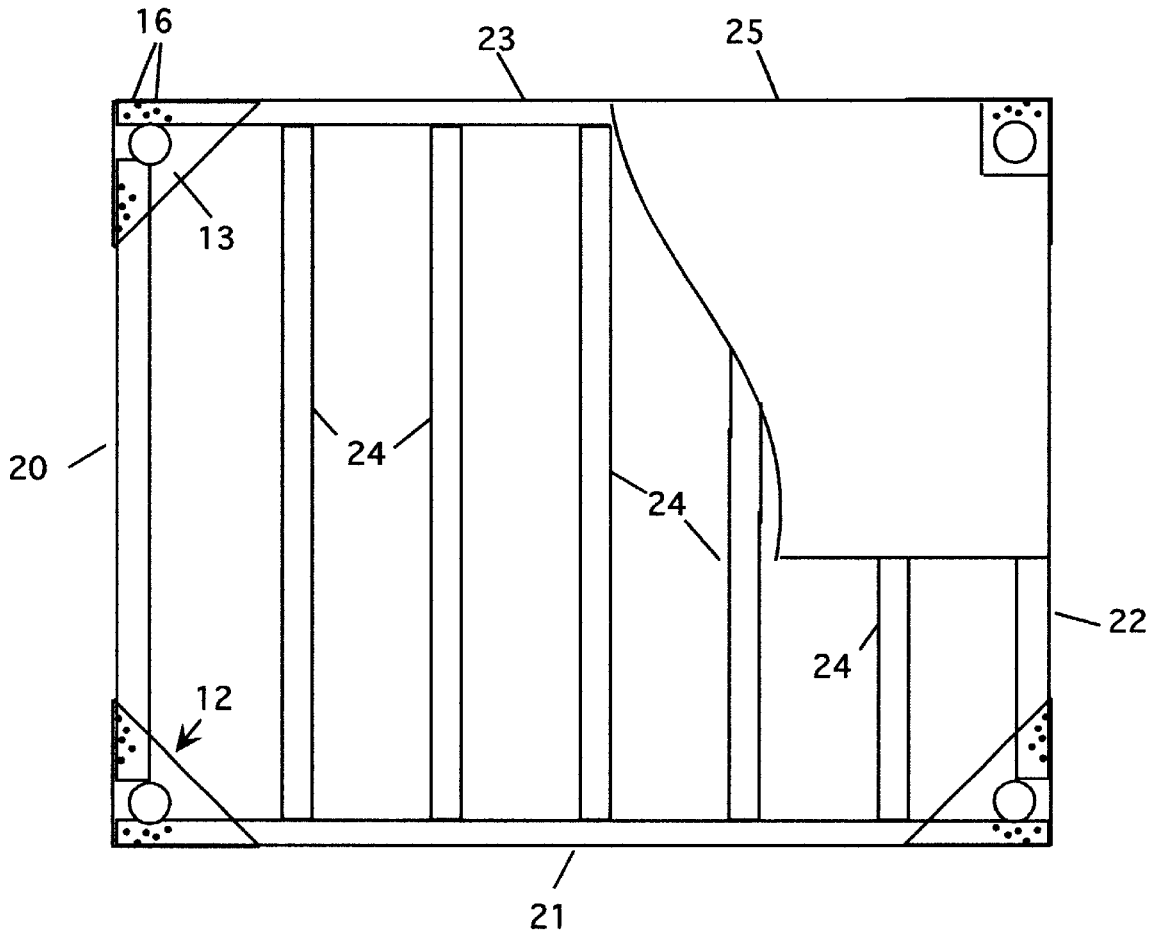
FIG. 8 is a top view of a platform showing the placement of the vertical posts, the corner brackets, the 2×4 framing and the plywood decking.
Figure 9:
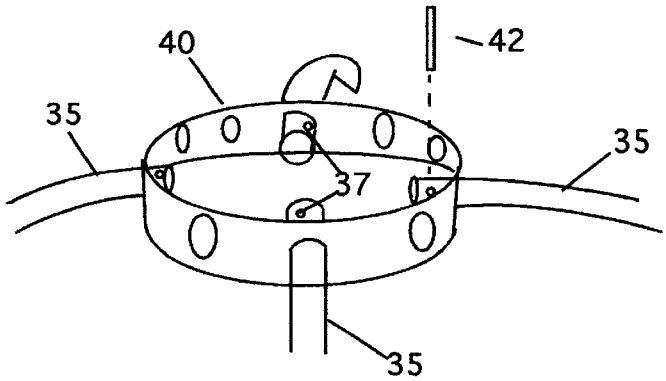
FIG. 9 is a detail view of the top ring showing four vertical elements in place.

FIG. 8 shows the framework and the vertical members. The outer 2×4s, 20, 21, 22, and 23 are placed as shown. Note how the holes 16 align with the 2×4s. Once the perimeter has been framed, addition joists 24 are placed within the frame as shown and secured with fasteners to the perimeter frame. The frame is then covered with plywood sheeting 25. The plywood ends are notched to fit around the vertical members as shown. Typically, the plywood is cut prior to locating the unit in the field.

Both the lower and upper floors are built in the same manner. Once the platform is finished, the outer tent can be built.

Figure 13:
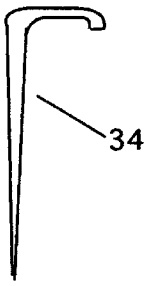
FIG. 13 is a side view of a tent stake.
Figure 14:
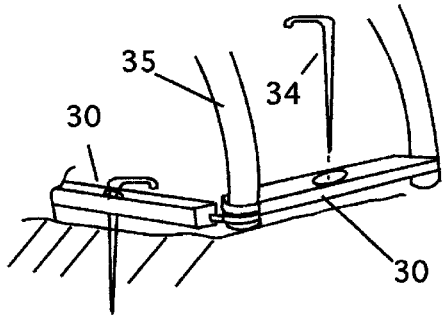
FIG. 14 is a detail view showing a stake being positioned in a lower frame element.
Figure 15:
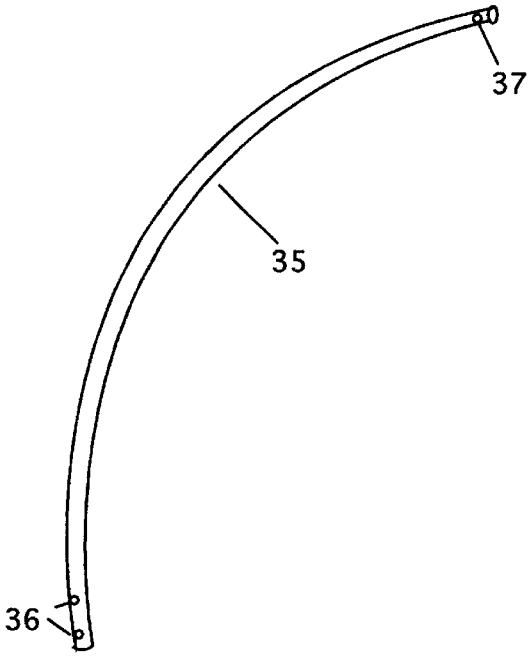
FIG. 15 is a side view of a vertical frame element.
Figure 16:
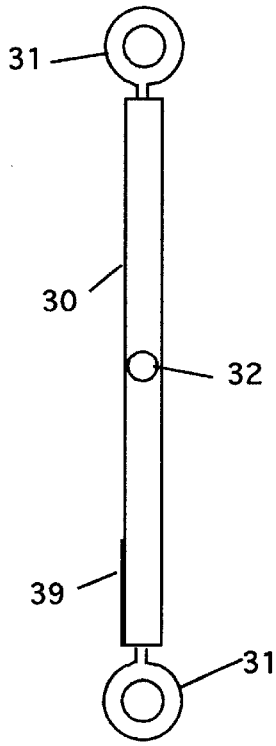
FIG. 16 is a top view of a lower frame element.

The tent portion is assembled from a number of components. FIGS. 9–20 show the tent's structural components the tent framework components. The base of the tent is formed using a number of lower frame brace 30. FIG. 16 shows a top view of a lower frame brace 30. In the preferred embodiment, 10 of the braces 30 are used. Each frame brace 30 has a pair of eyebolts 31 secured in the ends of the brace 30 as shown. The brace is a square piece of wood. In the preferred embodiment, each brace is five feet long from eyebolt center to eyebolt center and made from 2×2 dimensional lumber. At the center of each brace is a hole 32. The hole 32 is approximately ½-inch in diameter. However, the hole 32 can be any reasonable size. The holes 32 are used for stakes 34, shown in FIG. 13. FIG. 14 shows the placement of the stakes 34 in the holes 32. This procedure is also described in more detail below. Finally, each brace 30 has a small strip of VELCRO 39, a hook and loop fastener, attached to one side of the outer face of the brace as shown.

The tent frame has a number of bent poles 35. The poles are shown in FIG. 15. The poles may be made of 1-inch tubing, or may be lighter weight flexible tubing. The bent poles 35 are approximately 14 feet long. As discussed below, one end of the poles fits in the eyebolts 31 at the base of the tent. Two holes 36 are provided to secure the poles to the lower tent frame braces. This procedure is discussed below. The tops of the poles 35 have a hole 37 that is used to secure the pole into a band 40, as shown in FIG. 15. The band 40, in the preferred embodiment is metal. The band 40 is approximately 2 feet long and 2 inches wide. A number of holes 41, corresponding to the number of poles, are cut into the band as shown. The band is formed into a circle, as shown. The poles 35 pass through the holes 41. Pins 42 are placed through the holes 37 to secure the tops of the poles within the band 40. See FIG. 9.

Figure 17:
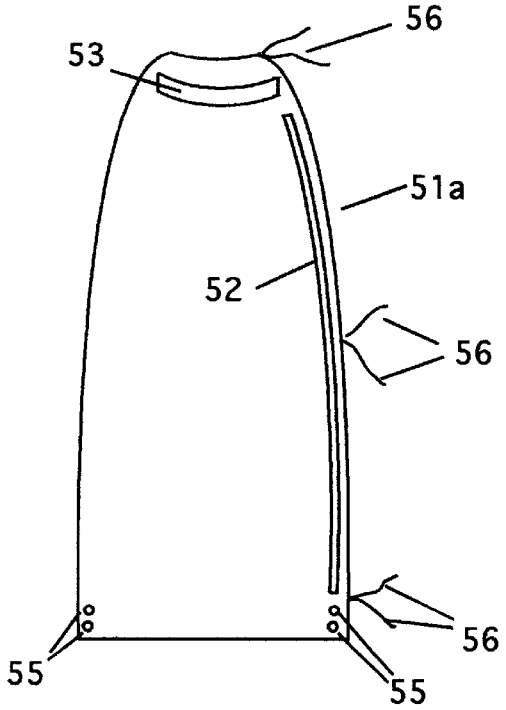
FIG. 17 is an outside view of the first section of canvas covering.
Figure 18:
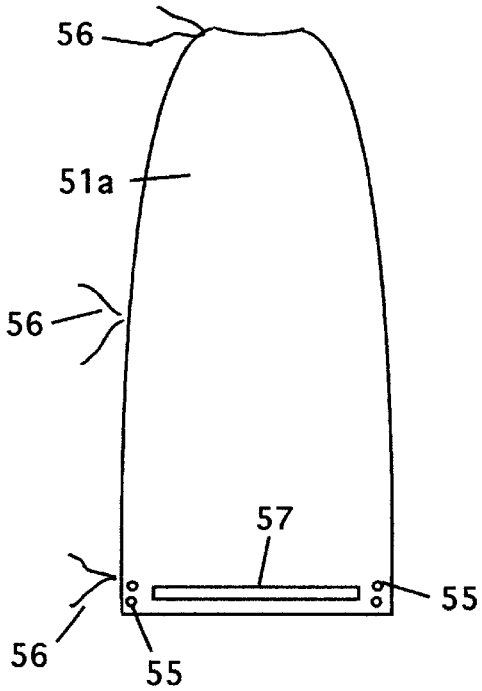
FIG. 18 is an inside view of a typical section of canvas covering.
Figure 19:
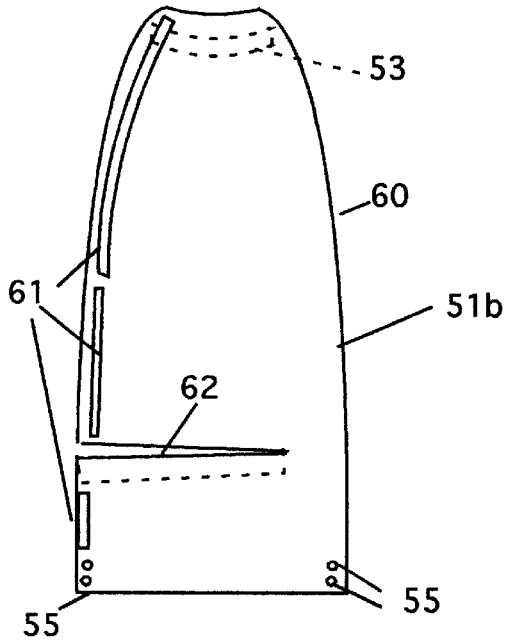
FIG. 19 is an inside view of the final canvas section.

The tent material is made of canvas or other waterproof material. The tent wall 50 is made up of several tent panels 51. The tent panels 51 have similar characteristics, except for the first and last panels. All the panels are sewn together except for the first and last panels, where one end of those panels are left open to allow the tent material to be placed over the frame. FIG. 17 shows the outer surface of the first panel 51*a* . This panel is generally shaped as shown. On the right side, a strip of VELCRO 52, a hook and loop fastener is attached as shown. At the top, a second loop of VELCRO 53 is attached as shown. Two pairs of grommets 55 are placed at the bottom corners as shown. Finally, a number of ties 56 are placed on the right side of the first panel as shown. The second panel is then sewn to the left side of the first panel (from the perspective of the outside of the panel as shown in FIG. 17). FIG. 18 shows the inside face of the first panel 51*a* . This face has a strip of VELCRO 57 as shown. All of the remaining panels, with the exception of the last panel, have the same shape as the first panel. All the intermediate panels have a strip of VELCRO 53 secured to the outer face at the top and a second strip of VELCRO 57 at the bottom of the inner face. FIG. 19 shows the inner face of the last panel 51*b* . This panel is sewn to the last intermediate panel on one side 60. On the other side, are strips of VELCRO 61 as shown. This panel has a small slit 62 cut into the outer edge as shown. Like the other panels, this panel also has the two pairs of grommets 55 and an outer strip of VELCRO 53.

Figure 20:
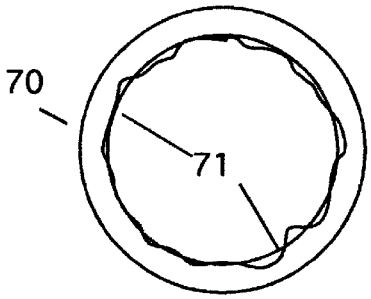
FIG. 20 is a bottom view of the canvas top cap.

FIG. 20 is an inner view of a top cap 70 that is used to cover the ring 40. The top cap 70 has a continuous strip of VELCRO 71 within the inner perimeter. This strip 71 engages with the VELCRO strips 53 at the top of the tent panels to seal the top of the tent.

Figure 10:
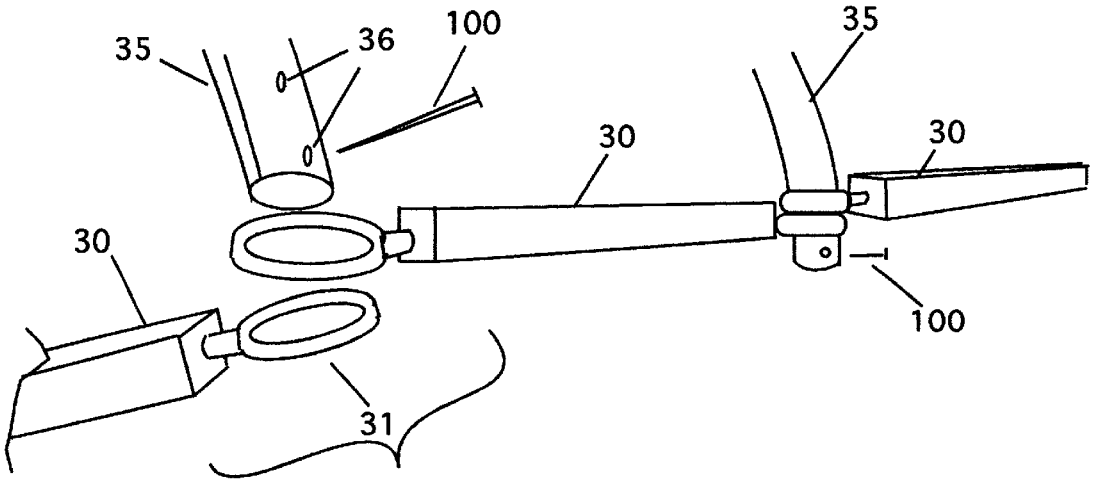
FIG. 10 is a detail view of the lower frame members being temporarily assembled with the vertical elements.
Figure 11:
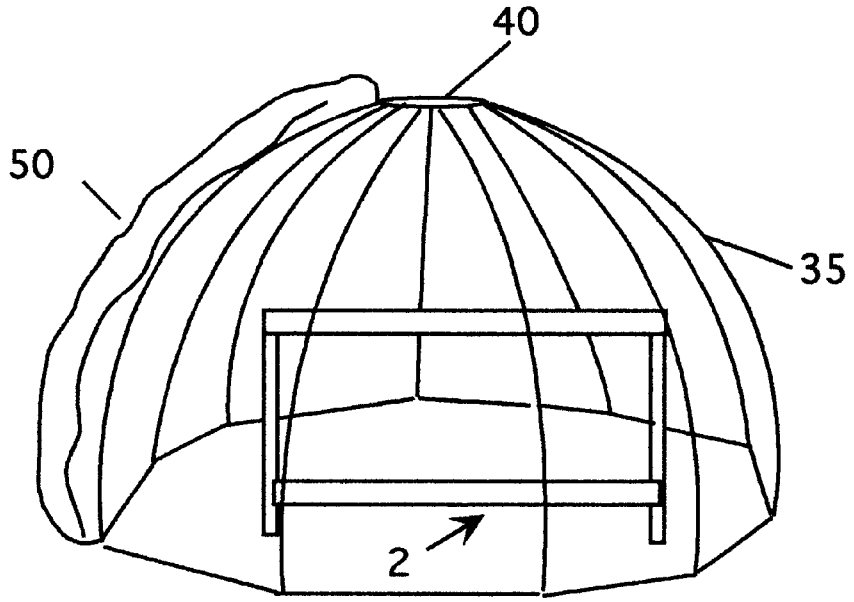
FIG. 11 is a detail view showing the frame in place around the platform and the tent covering being installed.
Figure 12:
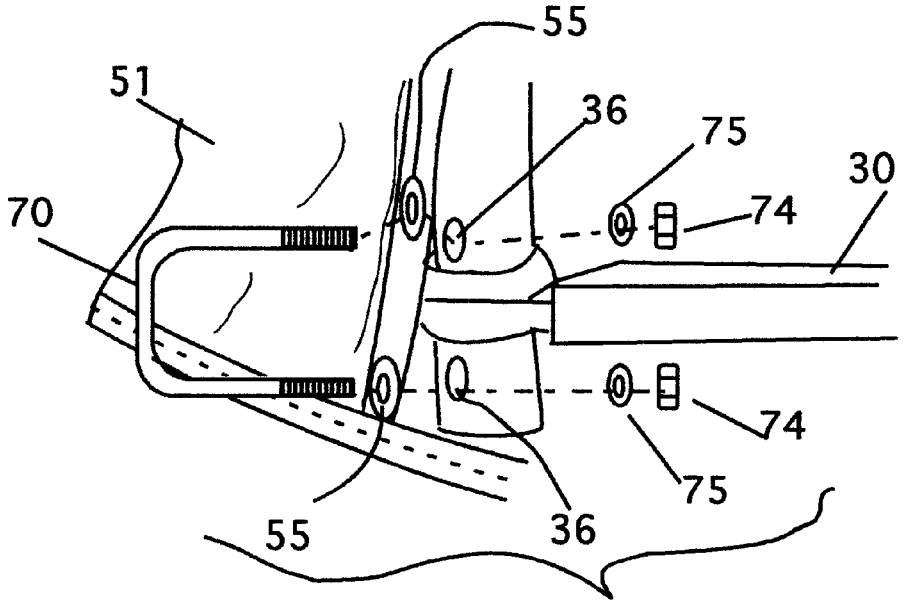
FIG. 12 is a detail view showing the final assembly of the frame elements and the tent fabric.

Referring now to FIGS. 10–12, the tent and platform are installed as follows: first, find a level ground surface. Then position the first corner post and screw it into the ground to a one-foot depth. Use a level to make sure the post is plumb. Place a platform bracket on the post and measure for the second support post location. At that location, screw in the second post. Repeat this procedure for the remaining posts, placing the posts in a rectangular pattern. Once the posts are set and plumb, secure the platform brackets to the posts using screws, nuts, bolts or other common fasteners. Next, secure the vertical and horizontal 2×4 frame members for the lower platform, securing them to the platform brackets. Once these are secure, add joists at 16 inches on center. Next place a sheet of plywood on the lower platform and secure it to the framework. Then, install a second set of platform brackets at the top of the vertical 2×4 members. Repeat the placement of horizontal members and joists, cover the top platform with plywood, and secure it to the joists as before. FIG. 8 shows this assembly.

Once the platform is completed, place the tent braces in a circle. The diameter of the preferred embodiment is sixteen feet. The platform is in the center of the circle. Assemble four vertical tent tubes and the top band on the top platform. The tubes are positioned at 90-degree increments and are installed on the top band with hardware. See FIG. 10. The bottom end of each tube is placed through two of the eyebolts found at the ends of the braces. In this way, the braces are interlocked with the tubes. Temporarily secure the tubes to the braces using a nail 100 as shown. This step is shown in FIG. 10. Install the remaining braces using the same techniques. Tie the end of the first panel of rolled canvas tent material to the top band, the middle of one tube and the bottom of the same tube. See FIG. 11. Proceed to unroll the canvas around the frame. At each tube position, replace the nail with a "U" bolt that is placed through grommets 55 in the canvas. As shown in FIG. 13, a "U" bolt 70 then passed through two holes 36 in the tube (one above the eyebolts 31 and one below). The "U" bolts are secured with nuts 75 and lock washers 75. See FIG. 12. The VELCRO strips 57 are secured to the VELCRO strips 39 on the frame braces, as each panel is unrolled. When the entire canvas is unrolled, the last panel is mated with the first panel using the VELCRO strips, as discussed above. Finally, the tent cap is secured over the ring to seal the tent and make it weather tight.

Once the canvas is secured to the frame, a stake is driven through holes in each of the braces to secure the tent to the ground. The tent is then ready to use.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A two-level platform tent comprising:

a) a platform, having a lower level and an upper level;

b) a tent, removably constructed around said platform;

c) wherein said tent comprises an outer covering having a bottom; a lower frame; and an internal frame; and further wherein the internal frame includes: a plurality of vertical frame members, wherein each of said plurality of vertical members comprise a piece of tubing, removably attached to said lower frame; and a top ring, removably attached to upper ends of said plurality of vertical members; and d) wherein said lower frame includes a plurality of frame members, and further wherein each of said plurality of frame members comprises:

a) a body, having two ends and a front face;

b) a first eye, being installed in one of said two ends of said body;

c) a second eye, being installed in the second of said two ends of said body; and d) the first eye of one frame member being aligned with the second eye of an adjacent second frame member to receive and secure a lower end of one respective vertical member.

2. The two-level platform tent of claim 1 wherein said platform further comprises:

a) a plurality of posts, attached to said platform, to support said upper and lower levels above a ground surface; and b) means for securing said plurality of posts to said ground surface.

3. The two-level platform tent of claim 2 wherein said platform further comprises:

a) a plurality of brackets, removably secured to said plurality of posts;

b) a plurality of frame members, removably attached to said plurality of brackets, thereby forming a frame for the lower level and the upper level; and c) a means for covering said plurality of frame members, thereby forming a flat surface for said lower level and said upper level.

4. The two-level platform tent of claim 3 further comprising a plurality of intermediate frame members, removably attached to said plurality of frame members.

5. The two-level platform tent of claim 2 wherein the means for securing said plurality of posts to said ground surface comprise a plurality of screw augers, removably attached to said plurality of posts.

6. The two-level platform tent of claim 1 further comprising a plurality of base plates, removably attached to said plurality of posts, whereby each of said plurality of base plates supports one of said plurality of posts on a ground surface.

7. The two-level platform tent of claim 1 wherein said outer covering further comprises:

a) a first wall panel, having a first end and a second end;

b) a plurality of wall panels, fixedly attached to said second end of said first wall panel; and c) an end wall panel, fixedly attached to said plurality of wall panels and being removably attached to said first end of said first wall panel.

8. The two-level platform tent of claim 1 wherein each of said plurality of vertical members comprise a rigid piece of tubing.

9. The two-level platform tent of claim 1 wherein each of said plurality of vertical members comprise a flexible piece of tubing.

10. The two-level platform tent of claim 1 further including a means for removably securing said outer covering to said top ring.

11. The two-level platform tent of claim 10 wherein the means for removably securing said outer covering to said top ring include:

a) a top cap, removably installed around said top ring; and b) a means for securing said outer covering to said top cap.

12. A method of construction of a two-level platform tent comprising the steps of:

a) assembling a first level of a platform;

b) assembling a second level of a platform, thereby forming a two-level platform;

c) assembling a plurality of frame members around said two-level platform, thereby creating a lower frame around said two level platform, wherein the lower frame comprises a plurality of frame members, and further wherein each of said plurality of frame members comprises: a body, having two ends and a front face; a first eye, being installed in one of said two ends of said body a second eye, being installed in the second of said two ends of said body; and a means for securing the bottom of said outer covering to said lower frame, said assembly including the steps of:

i) placing the second eye of one of said plurality of frame members over the first eye of a second of said plurality of frame members;

ii) securing said second eye of one of said plurality of frame members to the first eye of a second of said plurality of frame members; and iii) repeating steps i and ii until all of said plurality of frame members are secured together;

d) attaching a plurality of vertical members to said eyes of said frame members of said lower frame;

e) attaching a top ring to said plurality of vertical members, thereby creating a tent frame;

f) attaching one end of an outer covering, having a plurality of sections to one of said plurality of rigid vertical members and to a frame member;

g) unrolling said outer covering around said tent frame, securing said tent to said lower frame;

h) securing a last outer covering panel to one of said plurality of rigid vertical members and to a frame member, thereby completing a tent structure around said two level platform.

13. The method of construction of a two-level platform tent of claim 12 further comprising the steps of:

a) placing a top cap over said top ring; and b) securing said top cap to said outer covering.

* * * * *